US007543464B2

(12) United States Patent
Choi et al.

(10) Patent No.: US 7,543,464 B2
(45) Date of Patent: Jun. 9, 2009

(54) APPARATUS AND METHOD FOR SWITCHING POWER TRANSMISSION MODE OF WASHING MACHINE

(75) Inventors: Du Heig Choi, Changwon-si (KR); Bon Kwon Koo, Changwon-si (KR); In Haeng Cho, Changwon-si (KR)

(73) Assignee: LG Electronics Inc., Seoul (KR)

( * ) Notice: Subject to any disclaimer, the term of this patent is extended or adjusted under 35 U.S.C. 154(b) by 781 days.

(21) Appl. No.: 10/503,567

(22) PCT Filed: Nov. 26, 2003

(86) PCT No.: PCT/KR03/02576

§ 371 (c)(1),
(2), (4) Date: Aug. 5, 2004

(87) PCT Pub. No.: WO2004/048675

PCT Pub. Date: Jun. 10, 2004

(65) Prior Publication Data

US 2005/0120759 A1 Jun. 9, 2005

(30) Foreign Application Priority Data

| | | |
|---|---|---|
| Nov. 26, 2002 | (KR) | 10-2002-0073855 |
| Nov. 26, 2002 | (KR) | 10-2002-0073879 |
| Nov. 26, 2002 | (KR) | 10-2002-0073880 |
| Nov. 26, 2002 | (KR) | 10-2002-0074078 |
| Nov. 26, 2002 | (KR) | 10-2002-0074079 |
| Nov. 26, 2002 | (KR) | 10-2002-0074080 |
| Nov. 26, 2002 | (KR) | 10-2002-0074081 |
| Nov. 26, 2002 | (KR) | 10-2002-0074082 |

(51) Int. Cl.
*D06F 39/00* (2006.01)

(52) U.S. Cl. ..... 68/12.24; 8/158; 68/133; 68/258

(58) Field of Classification Search ..... 8/158; 68/12.24, 133, 258
See application file for complete search history.

(56) References Cited

U.S. PATENT DOCUMENTS

| | | | | |
|---|---|---|---|---|
| 4,779,430 | A * | 10/1988 | Thuruta et al. | 68/12.04 |
| 5,150,489 | A * | 9/1992 | Kaji et al. | 8/159 |
| 5,551,261 | A * | 9/1996 | Lyu et al. | 68/23.6 |
| 5,887,458 | A * | 3/1999 | Bae | 68/23.7 |
| 2002/0166349 | A1 | 11/2002 | Lim et al. | |
| 2003/0177794 | A1 * | 9/2003 | Yoon et al. | 68/12.01 |

FOREIGN PATENT DOCUMENTS

| | | |
|---|---|---|
| JP | 63-226397 | 9/1988 |

(Continued)

*Primary Examiner*—Frankie L Stinson
*Assistant Examiner*—Samuel A Waldbaum
(74) *Attorney, Agent, or Firm*—McKenna Long & Aldridge LLP

(57) ABSTRACT

An apparatus and method for switching a power transmission mode of a washing machine id disclosed, to prevent malfunction and damages of the washing machine by switching the power transmission mode stably in which the method includes: (a) rotating the cam (600) by driving the clutch motor (60); (b) counting the number of pulses of power supplied to the clutch motor (60); and (c) maintaining the rotation of the cam (600) until the ounted number of pulses is equal to, or greater than a preset number of pulses.

12 Claims, 12 Drawing Sheets

FOREIGN PATENT DOCUMENTS

| | | |
|---|---|---|
| JP | 11-033281 | 2/1999 |
| JP | 11-244578 | 9/1999 |
| JP | 2000-024366 | 1/2000 |
| JP | 2000-24375 | 1/2000 |
| JP | 2001-46784 | 2/2001 |
| KR | 100186573 | 12/1998 |

* cited by examiner

APPARATUS AND METHOD FOR SWITCHING POWER TRANSMISSION MODE OF WASHING MACHINE

TECHNICAL FIELD

The present invention relates to a washing machine, and more particularly, to an apparatus and method for switching a power transmission mode of a washing machine.

BACKGROUND ART

In general, the washing machine removes various dirt stuck to clothes, beddings, and the like by using softening action of detergent, friction caused by circulation of water coming from rotation of a pulsator, and impact applied to the laundry by the pulsator, wherein an amount and kinds of laundry is detected with sensors, to set a washing method automatically, washing water is supplied appropriately according to the amount and kinds of the laundry, and the washing is carried out under the control of a microcomputer.

A related art full automatic washing machine is operated in two methods, one of which is transmission of a rotation power from a driving motor to a washing shaft or a spinning shaft with a power transmission belt or pulley, for rotating the pulsator or a spinning tub, and the other of which is rotating a washing and spinning tub at different speeds in washing and spinning under the speed control of a brushless DC motor.

However, the related art washing machine has the process of switching a power transmission mode. In the related art washing machine, it is impossible to sense a mechanical engagement state and a switching state of a power transmission path during switching the power transmission mode. In this respect, it may generate damages to components during a washing or spinning cycle.

DISCLOSURE OF INVENTION

An object of the present invention is to provide an apparatus and method for switching a power transmission mode of a washing machine, to prevent malfunction and damages of the washing machine by switching the power transmission mode stably.

The object of the present invention can be achieved by providing an apparatus for switching a power transmission mode of a washing machine having a clutch including a coupling for selectively transmitting a power of a motor to a washing shaft and a spinning shaft, a clutch motor for driving the coupling, and a cam fitted to be rotatable with the clutch motor for providing a switching signal in response to the rotation; a power supplying part for supplying a voltage to the clutch motor; a pulse counting part for counting the number of pulses of power supplied to the clutch motor from the power supplying part; and a micom for repeating rotation of the cam until the counted number of pulses is equal to, or greater than a preset number of pulses on driving the clutch motor.

At this time, the micom sets the alternate rotation power of the motor according to the amount of laundry and water level. That is, the micom sets the alternate rotation power of the motor to be higher as the amount of laundry is large and the water level is high, and the micom sets the alternate rotation power of the motor to be lower as the amount of laundry is small and the water level is low.

Also, the micom sets the alternate rotation power according to a voltage inputted to the motor. That is, the micom sets the alternate rotation power of the motor to be lower as the voltage inputted to the motor is high, and the micom sets the alternate rotation power of the motor to be higher as the voltage inputted to the motor is low.

The micom rotates the motor alternately in left and right directions according to a preset alternate rotation power before driving the clutch motor and after stopping the clutch motor.

Also, the micom determines whether the motor is rotated when a power is reset, and the micom drives the clutch motor after rotation of the motor is stopped. Then. the micom turns off the power in case of that the motor is rotated after a lapse of a preset time period. Further, the micom drives the clutch motor, and simultaneously rotates the motor alternately in left and right directions.

In another aspect, a method for switching a power transmission mode of a thrashing machine includes (a)rotating the cam by driving the clutch motor; (b)counting the number of pulses of power supplied to the clutch motor; and (c)maintaining the rotation of the cam until the counted number of pulses is equal to, or greater than a preset number of pulses.

Also, the method further includes the steps of setting an alternate rotation power of the motor; and rotating the motor alternately in left and right directions according to the set alternate rotation power before the clutch motor is driven.

The alternate rotation power of the motor is set according to the amount of laundry and water level when setting the alternate rotation power of the motor.

The motor is rotated alternately in left and right directions at a rotation angle smaller than a rotation angle in the washing and rinsing cycles.

Also, the method further includes the step of determining whether the motor is rotated in case of that a power is reset. At this time, the power is turned off in case of that the motor is rotated after a lapse of a preset time period.

In another aspect, a method for switching a power transmission mode of a washing machine includes (a)rotating the cam by driving the clutch motor; (b)determining whether the switch is switched; (c)maintaining the rotation of the cam for a preset time period; and (d)stopping the clutch motor.

At this time, the step of determining whether the switch is switched includes the steps of determining whether the switch is turned on in case of switching to a pulsator mode, and of determining whether the switch is turned off in case of switching to a spinning tub mode.

Also, the step of maintaining the rotation of the cam for the preset time period includes the steps of counting the number of pulses of power supplied to the clutch motor, and of comparing the counted number of pulses with a preset number of pulses. Herein, the cam is rotated continuously until the counted number of pulses is equal to, or greater than the preset number of pulses.

The method further includes the step of rotating the motor with a preset alternate rotation power before driving the clutch motor and after stopping the clutch motor. Also, the alternate rotation power of the motor is set according to the amount of laundry and water level, or a voltage inputted to the motor.

BRIEF DESCRIPTION OF DRAWINGS

The accompanying drawings, which are included to provide a further understanding of the invention, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings. In describing the embodiments, same parts will be given the same names and reference symbols, and repetitive description of which will be omitted.

Figure 1:
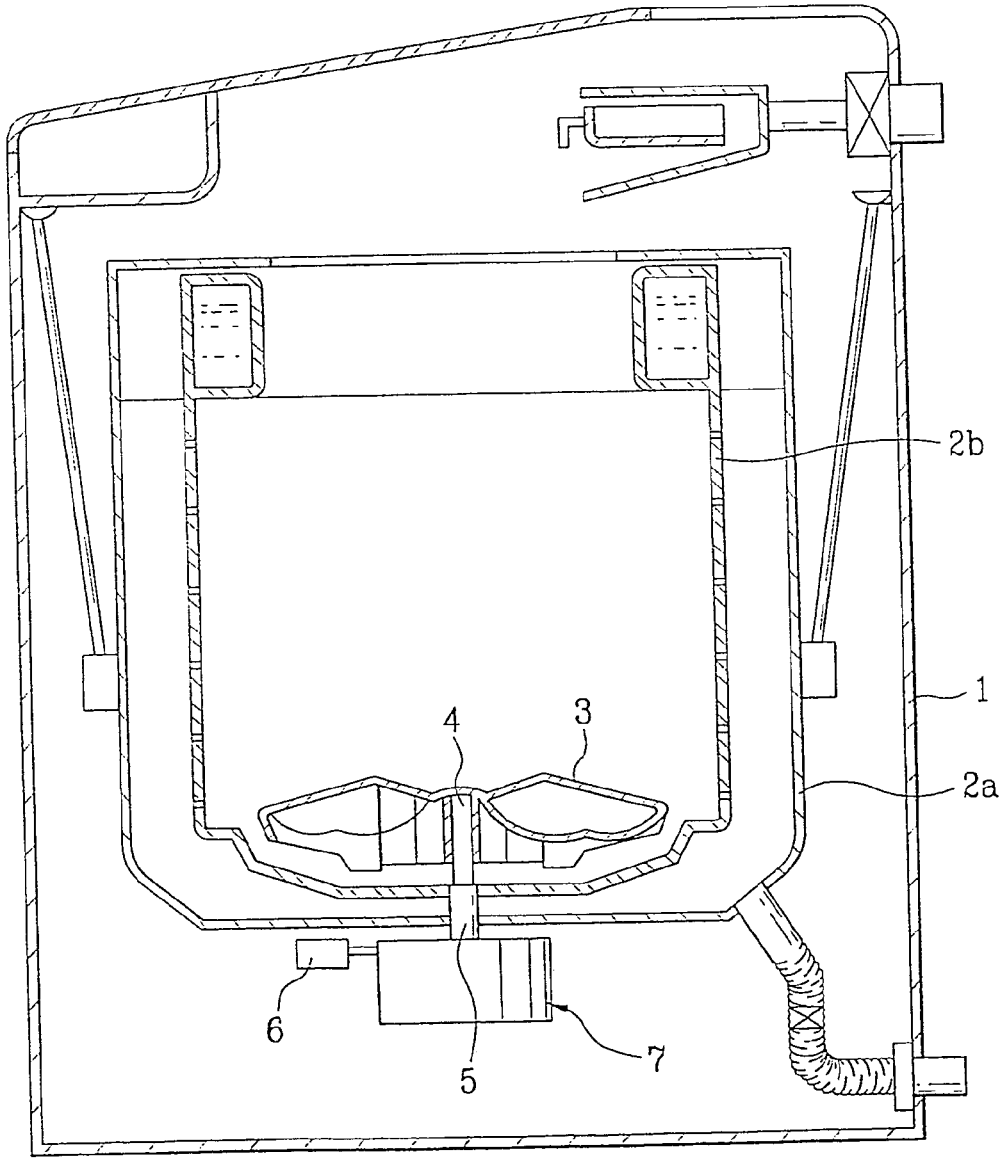
FIG. 1 Background Art
FIG. 1 is a schematic view illustrating a general washing machine.

FIG. 1 is a schematic view illustrating a general full automatic washing machine.

Referring to FIG. 1, the full automatic washing machine includes a body 1, an outer tub 2*a* mounted in the body 1, and an inner tub 2*b* rotatably mounted in the outer tub 2*a*. Also, there is a pulsator 3 mounted on a central part of a bottom of an inside of the inner tub 2*b*, the pulsator 3 rotating in left and right directions alternately in washing and spinning cycles.

The full automatic washing machine also includes a spinning shaft 5 for transmission of a rotation power to the inner tub 2*b*, a washing shaft 4 for transmission of a rotation power to the pulsator 3, and a clutch 6 for transmission of a power of the motor 7 to either the washing shaft 4 or the spinning shaft 5 depending on the washing or spinning cycle.

Figure 2A:
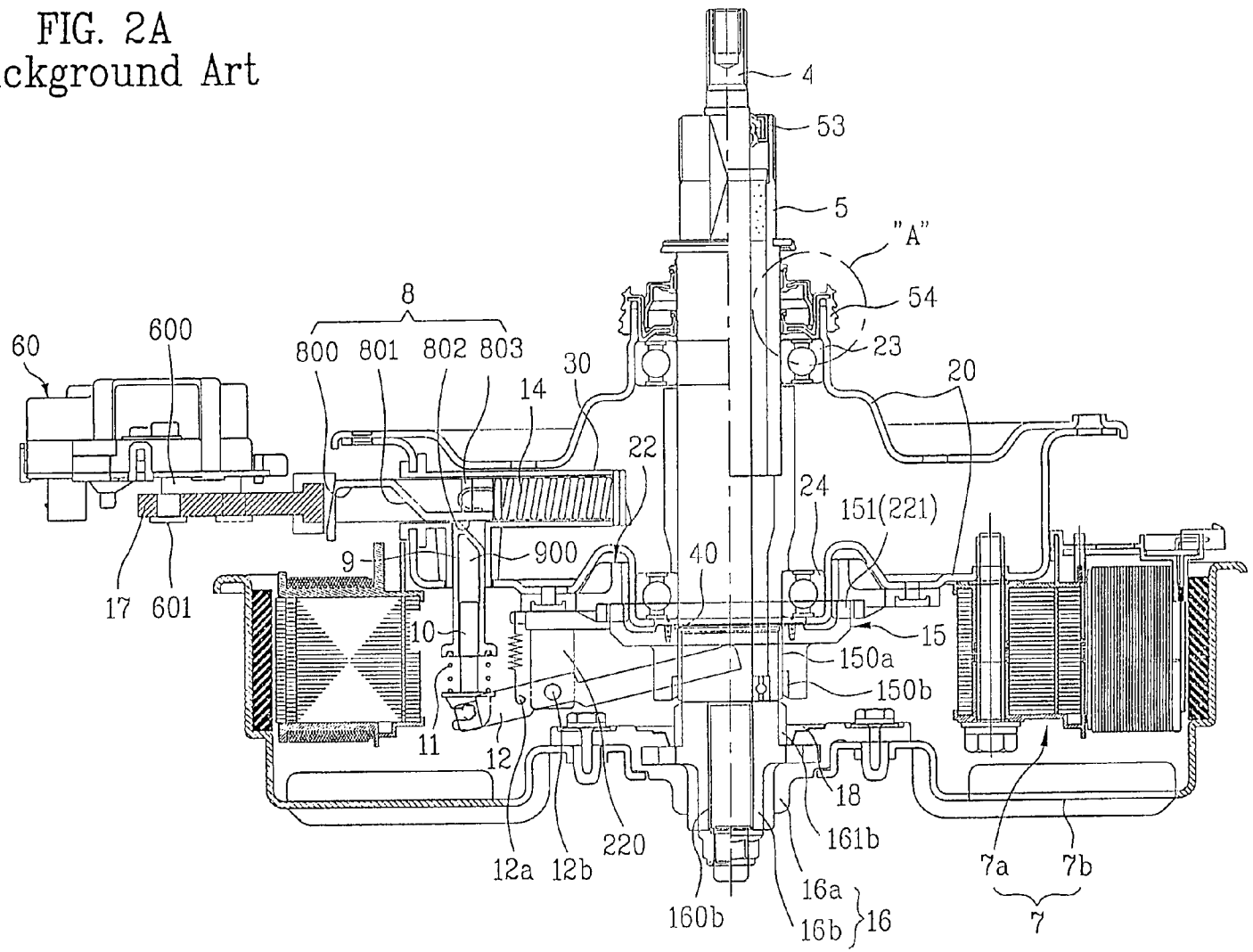
FIG. 2A Background Art
FIG. 2A and FIG. 2B are cross-sectional views illustrating a clutch and a motor of FIG. 1.
Figure 2B:
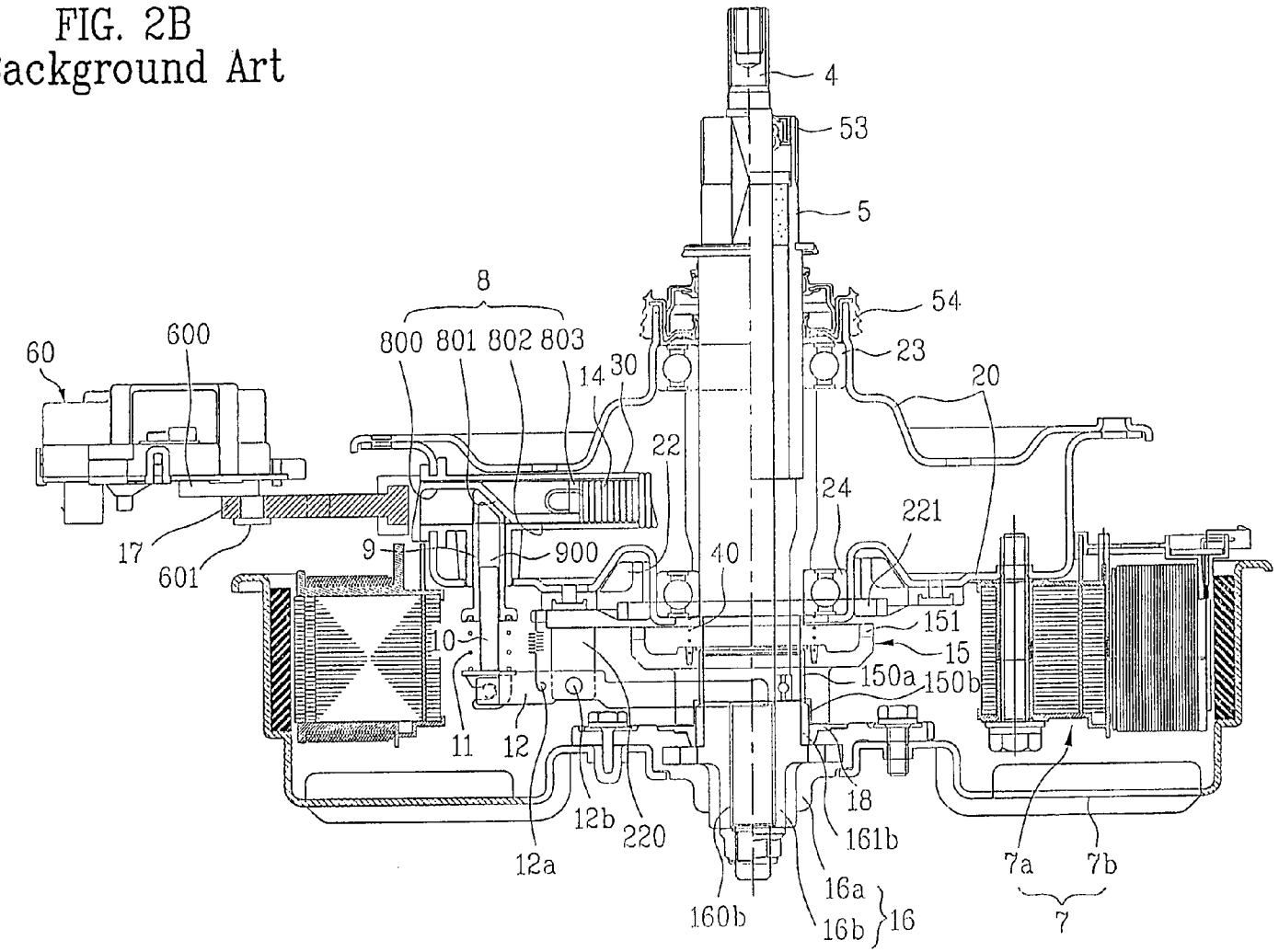
FIG. 2B Background Art

The clutch 6 has the following system. Referring to FIG. 2A and FIG. 2B, there is a clutch motor 60 under the outer tub 1, and a cam 600 mounted on a driving shaft 602 of the clutch motor 60. Also, there are a lever guide 30 fixed in a shaft support bearing case 20, and a lever 8 having a recess 800 with a sloped surface 801, and a flat surface 801 extended in a horizontal direction from a lower end of the sloped surface 801 for making a linear motion guided by the lever guide 30 when the clutch motor 60 is driven. There is a connecting rod 17 between the cam 600 and the lever 8 of the clutch motor 60 for pulling the lever 8 toward the clutch motor 60 when the clutch motor 60 is turned on. Then, there is a return spring 14 fastened between one end of the lever guide 30 and a projection 803 from the lever 8, for giving a restoring force to the lever 8 when the lever 8 moves away from an end of the lever guide 30. There is a cylindrical hollow mover 9 for being engaged with the recess 800 of the lever 8 in the spinning cycle, and moving down along the sloped surface 801 until the mover 9 stops at an underside of the flat surface 802 in switching to a washing mode. There are a plunger 10 fitted movable up/down along a guide groove 900 inside the mover 9, and a damping spring 11 between the mover 9 and the plunger 10. Also, there is a coupling stopper 22 having gear teeth 221 formed along a circumferential direction of the shaft support bearing case 20 and fixed to an underside of the shaft support bearing case 20. There is a fork-shaped rod 12 having a fore end of one side hinge-coupled with a lower end of the plunger 10, and a point of a middle part hinge-coupled with a lower end of a support bracket 220 formed below the coupling stopper 22, for making a seesaw movement around the point of the middle part when the plunger 10 moves up/down. There is a coupling 15 fitted to be movable up/down along the spinning shaft 5 for switching a rotation power transmission path of the BLDC motor 7. There is a connector assembly 16 for transmission of a rotation power of a rotor 7*b* to the washing shaft 4.

Figure 3:
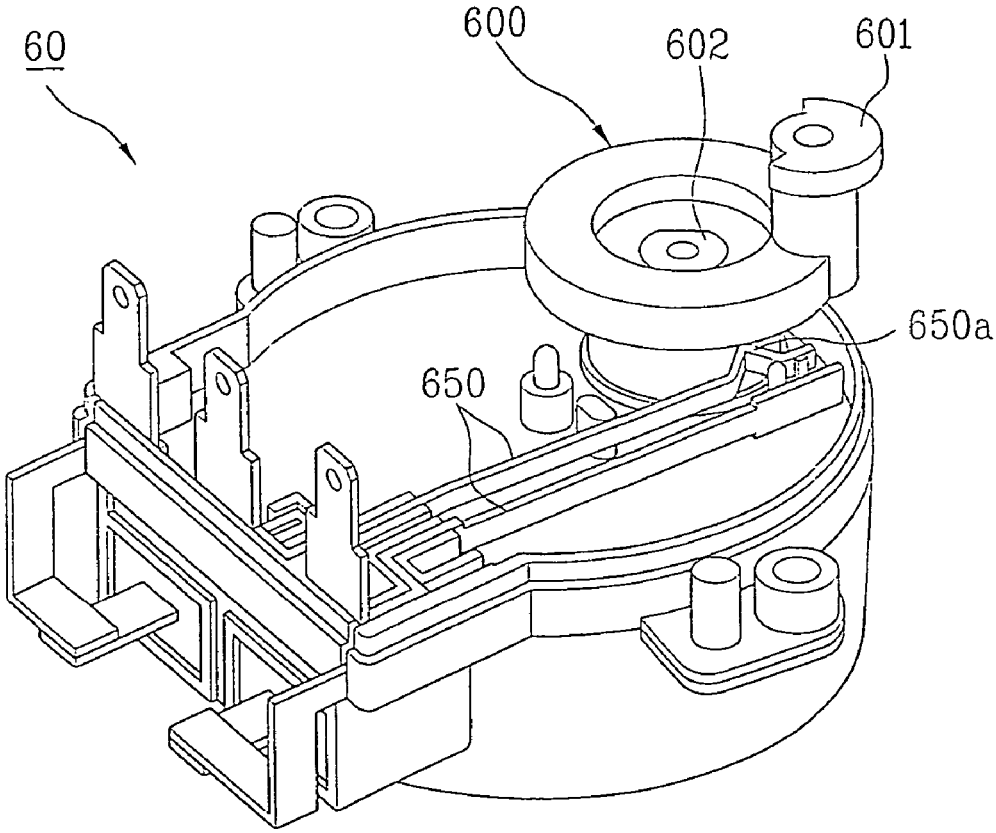
FIG. 3 is a perspective view illustrating a clutch motor according to the present invention.
Figure 4:
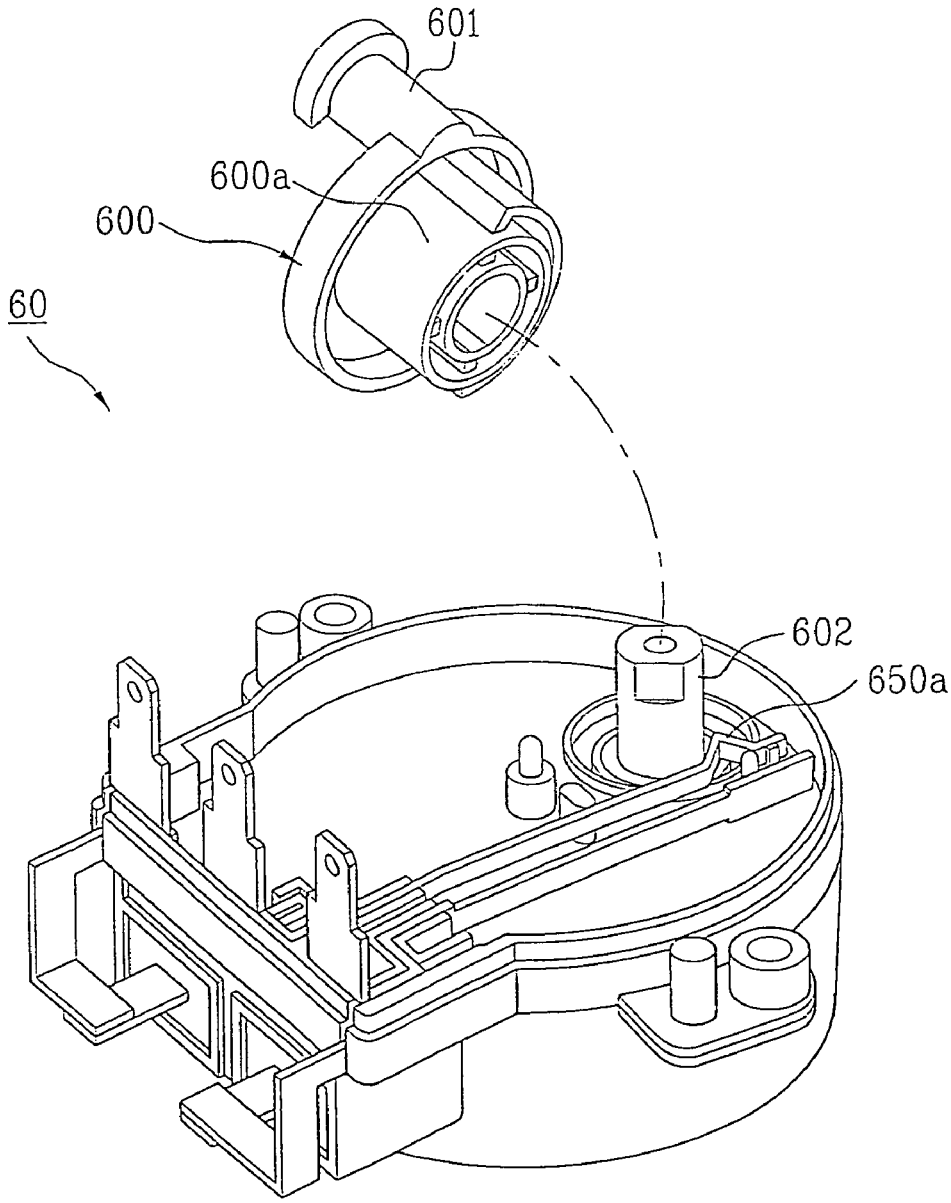
FIG. 4 is a disassembled perspective view of FIG. 3.

Referring to FIG. 3 and FIG. 4, the cam 600 is directly connected with the driving shaft 602, whereby the cam 600 is rotated at a uniform speed when the driving shaft 602 is rotated, and the cam 600 also stops where the driving shaft 602 stops.

An operational relation between the cam 600 and the switch 650 will be described as follows.

When the cam 600 is in a state consistent to an initial point, the switch 650 is in a turning-off state. As shown in FIG. SC, the state consistent to the initial point of the cam 600 is a state that a rod connecting shaft 601 of the cam 600 is at the initial point.

When it is intended to switch a power transmission path for washing, the clutch motor 60 is driven to turn the cam 600 in a counterclockwise direction. Since a projection 650*a* of the switch 650 is on a cam recess surface 600*a* until a rotation angle of the cam 600 reaches to 150° from the initial point, the switch 650 is in a turning-off state.

Thereafter, since the projection 650*a* from the switch 650 leaves the cam recess surface 600*a* as the rotation angle of the cam 600 reaches to 150° from the initial point, the switch 650 is turned on. When the rotation angle of the cam 600 reaches to 150° from the initial point, gear teeth 151 of the coupling 15 and the gear teeth 221 of the coupling stopper 22 come into engagement.

Figure 5A:
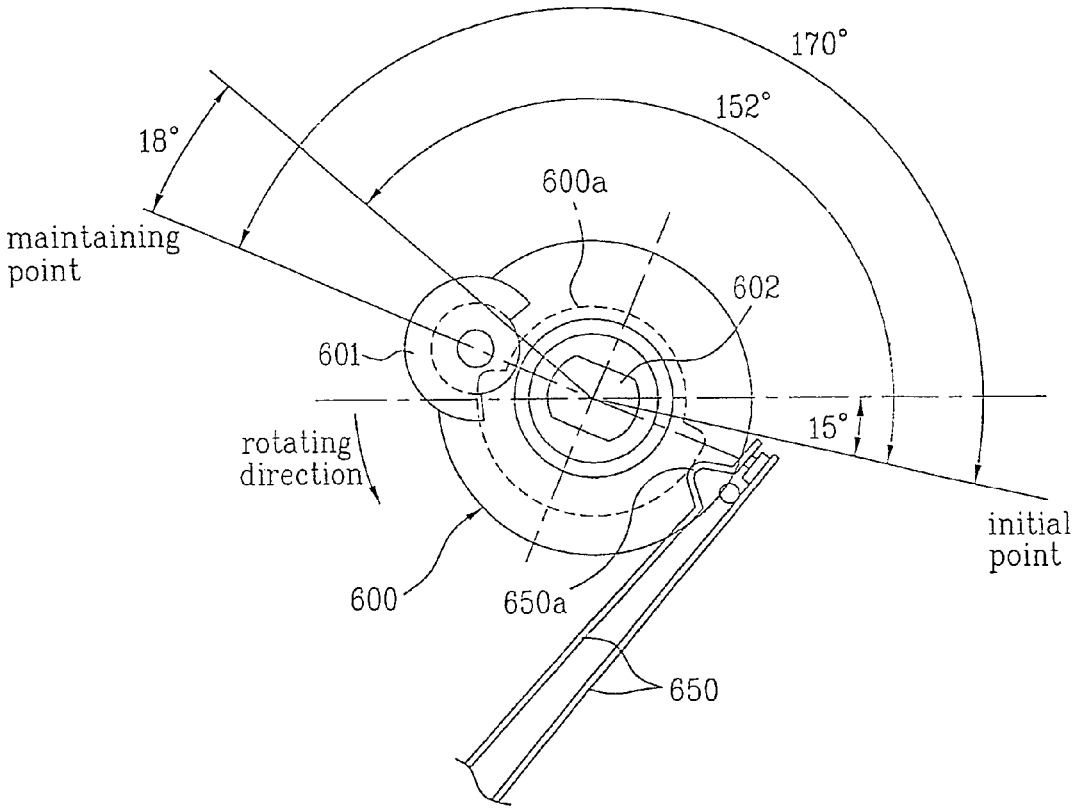
FIG. 5A to FIG. 5C illustrate an operational relation between a cam and a switch during driving a clutch motor.

After that, referring to FIG. 5A, when the cam 600 reaches to a point that is at 170° from the initial point, the clutch motor 60 is made to turn off. The reason that the clutch motor 60 is made to turn off at a point consistent to a maintaining point of the cam 600 is for more firm power switch to the washing mode.

Figure 5B:
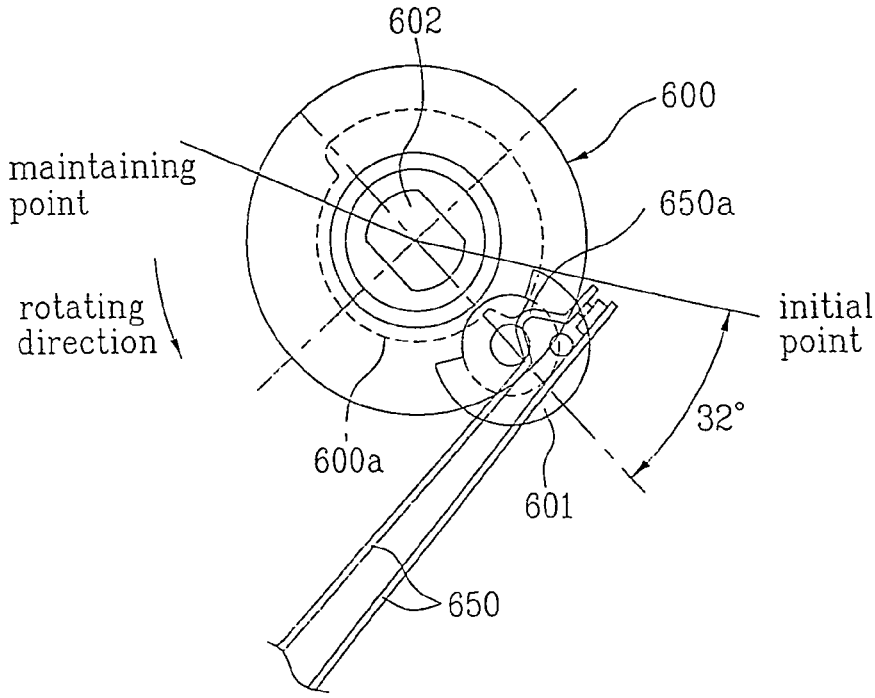
Figure 5C:
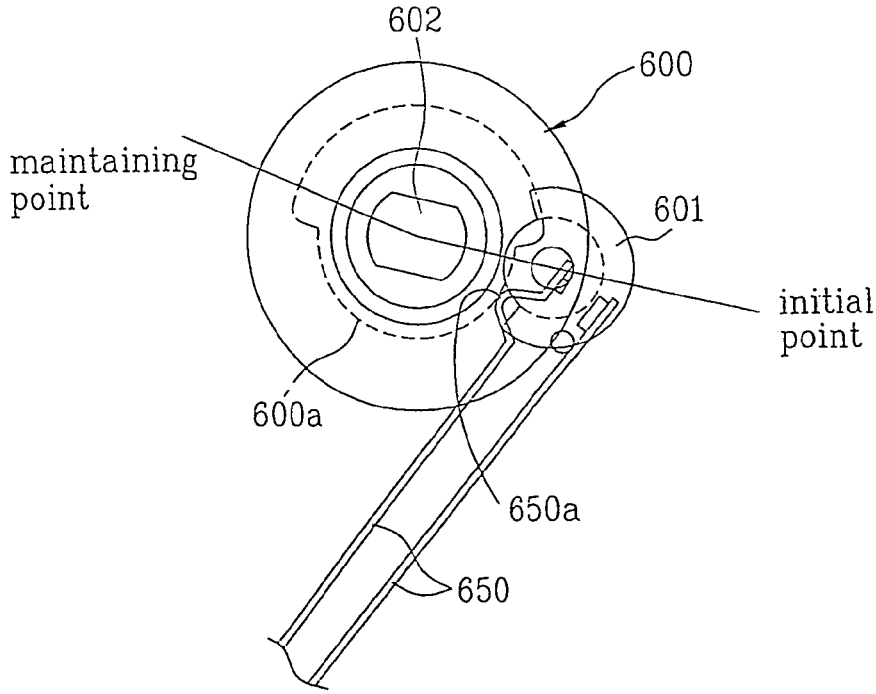
Figure 6:
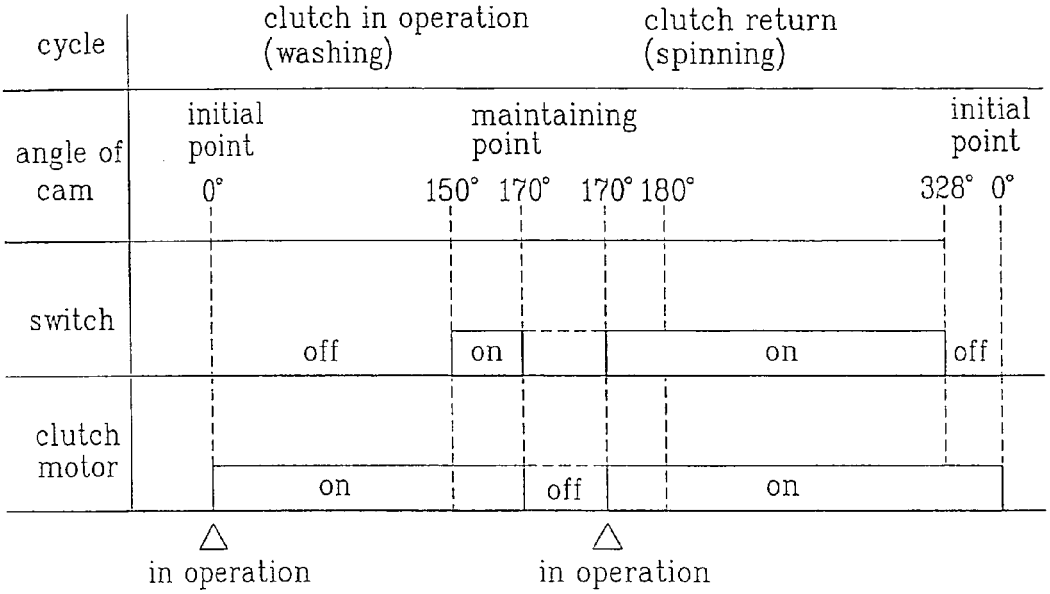
FIG. 6 is a chart illustrating operations of a clutch motor, a cam and a switch.

Meanwhile, in the spinning cycle after completing the washing cycle, it is required to return the cam 600 to a position consistent to the initial point. For this, at the time of power switch to the spinning mode, the clutch motor 60 is turned on again, to turn the cam 600 in the counterclockwise direction. In this instance, as shown in FIG. 5B, the switch 650 maintains a turning-on state until the cam 600 passes a point which is at 328° from the initial point in the counterclockwise direction (a point 158° from the maintaining point in the counterclockwise direction), when the projection 650*a* from the switch 650 comes to the cam recess surface 600*a*, to turn off the switch 650.

Therefore, even if the switch 650 is turned off, the clutch motor 60 maintains a turning-on state until the cam 600 reaches to a point consistent to the initial point under the control of the microcomputer, when the clutch motor 60 is turned off. In this instance, the number of pulses of an AC power supplied to the clutch motor 60 is counted while the clutch motor 60 is maintained in the turning-on state starting from a time right after the switch 650 is turned off to a time the cam 600 reaches to a point consistent to the initial point. By using the number of the pulses, the clutch motor 60 is controlled.

In the meantime, in state of that the cam 600 is at the initial point, not only the gear teeth 151 of the coupling 15 and the gear teeth 221 of the coupling stopper 22 are disengaged, but also an upper serration 150*a* and a lower serration 150*b* are engaged with a serration 161*b* on an outside circumferential surface of an upper part of an inner connector 16*b* and a serration on a lower part of the spinning shaft. 5 respectively at the same time, whereby the spinning by simultaneous rotation of the washing shaft 4 and the spinning shaft 5 is carried out.

Referring to FIG. 2B, before starting the washing cycle, the clutch 6 according to the present invention is in a turning-off state when no power is applied to the clutch motor 60, and the coupling 15 is moved down. At this time, the mover 9 is positioned in the recess 800 with the sloped surface 801 of the lever 8.

In this state, when power is applied to the clutch motor 60, to turn on the clutch motor 60, driving power of the clutch motor 60 is transmitted to the cam 600, the connecting rod 17 moves toward the clutch motor 60 as the cam 600 rotates, whereby the lever 8 is pulled toward the clutch motor 60 along the lever guide 30. In this instance, the return spring 14 provided in a rear end of the lever guide 30 is extended.

In the meantime, the mover 9 brought into contact with the sloped surface 801 of the lever 8 when the cam 600 rotates, moves down along the sloped surface 801, until the mover 9 comes to the underside of the flat surface 802 of the lever 8, as shown in FIG. 2A, at a time the cam 600 comes to the maintaining point.

While the mover 9 moves down according to rotation of the cam 600 and movement of the lever 8 toward the clutch motor, the mover 9 compresses the damping spring 11, whereby the plunger 10 fitted to be movable along the guide groove 900 also moves down.

Subsequently, as the plunger 10 moves down, the rod 12 hinge-coupled with the plunger 10 rotates around a fastening pin 12*b* at the point of the middle part of the rod 12 passing through the support bracket 220 of the coupling stopper 22 in the counterclockwise direction.

While the rod 12 rotates around the fastening pin 12*b* in the counterclockwise direction, an end of the rod 12 is brought into contact with the lower part of the coupling 15, and pushes up the coupling 15 along the spinning shaft 5 in an upper part of the shaft. Accordingly, as shown in FIG. 2A, when the power switch to the washing mode is finished, the gear teeth 151 on the upper part of the coupling 15 are engaged with the gear teeth 221 on the coupling stopper 22.

When the gear teeth 151 on the coupling 15 are engaged with the gear teeth 221 on the coupling stopper 22, the coupling 15 is freed from the connector assembly 16, such that only the washing shaft 4 rotates when the rotor 7*b* rotates. That is, in the washing cycle, because the coupling 15 is engaged only with the serration on the outside circumferential surface of the spinning shaft 5, but not with the serration on the upper part of the inner connector 16*b* engaged with the washing shaft 4, the rotation power is transmitted from the rotor 7 only to the pulsator 3 through the washing shaft 4.

In the state the gear teeth 151 on the coupling 15 are engaged with the gear teeth 221 on the coupling stopper 22, the gear teeth 221 on the coupling stopper 22 prevent the coupling 15 from being rotated.

Referring to FIG. 2A, when the switch of a power transmission path to the spinning tub mode is required for progressing spinning as the washing is finished while the washing is progressed, power is applied to the clutch motor 60 again, to drive the clutch motor 60, and rotate the cam 600.

When the cam 600 of the clutch motor 60 moves to a spinning position, the lever 8 moves away from the clutch motor 60 by a restoring force of the return spring 14. Accordingly, as shown in FIG. 2B, the mover 9 being in contact with the flat surface 802 of the lever 8 is positioned in the recess 800 with the sloped surface 801 of the lever 8 at the time returning of the lever 8 is finished.

As the mover 9 moves up according to the movement of the lever 8, the compression on the damping spring 11 is eased, whereby the plunger 10 moves up along the guide groove 900 in the mover 9. Following the move up of the plunger 10, the rod 12 hinge-coupled to the plunger 10 turns around the fastening pin 12*b* in a clockwise direction when the drawing (FIG. 2A) is seen from above.

Following the clockwise direction rotation of the rod 12 around the fastening pin 12*b*, the force of an end of the rod 12 which supports the coupling 15 is eliminated. Then, the coupling 15 moves down by gravity and the restoring force of the compression spring 40, whereby the gear teeth 151 of the coupling 15 is disengaged from the gear teeth 221 of the coupling stopper 22.

When the coupling 15 moves down fully, the serrations 150*a* and 150*b* on an inside circumferential surface of the coupling 15 are engaged with the serration 161*b* and the serration in a lower part of the spinning shaft 5, so that spinning is carried out as the spinning of the washing shaft 4 and the spinning shaft 5 are carried out at the time of spinning the rotor 7*b*.

Figure 7:
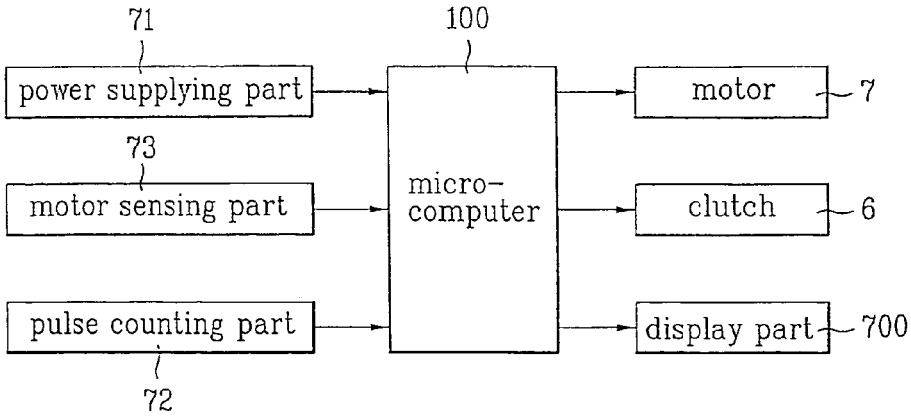
FIG. 7 is a block diagram illustrating an apparatus for switching a power transmission mode according to the present invention.

Referring to FIG. 7, an apparatus for switching a power transmission mode of a washing machine according to the present invention includes a power supplying part 71, a pulse counting part 72, a motor sensing part 73, a microcomputer (hereinafter, micom) 100, a motor 7, a clutch 6, and a display part 700.

Referring to FIG. 3 and FIG. 4, the clutch 6 includes a clutch motor 60 for moving up/down a coupling 15 proper to a washing or spinning cycle, and a cam 600 fitted to be rotatable with the clutch motor 60 for providing a switching signal in response to the rotation.

The power supplying part 71 supplies a voltage to the motor 7 and the clutch motor 60, and the pulse counting part 72 counts the number of pulses of an AC power supplied to the clutch motor 60 from the power supplying part 71. Also, the motor sensing part 73 senses the rotation of the motor 7.

The micom 100 checks whether the cam 600 is driven within a preset time period after driving the clutch motor 60. If the cam 600 is not driven within the preset time period, the micom 100 turns off the clutch motor 60, and puts the clutch motor 60 into operation again, and re-checks whether the cam 600 is driven.

Also, if a user requires switching of the power transmission mode manually, the micom 100 senses the position of the cam 600, and determines whether the cam 600 is in a correct position. If it is determined that the cam 600 is in the correct position, the micom 100 switches the power transmission mode. Then, the micom 100 controls the display part 700 so as to display the switched power transmission mode, the engagement state between the gear teeth 151 of the coupling 15 and the gear teeth 221 of the coupling stopper 22, and malfunctions thereof.

A method for switching a power transmission mode of a washing machine according to the present invention will be described as follows.

FIRST EMBODIMENT

In general, a washing machine is operated in two modes. One is a pulsator mode employed in a washing or rinsing cycle, and the other is a spinning tub mode employed in a spinning cycle.

First, a switching process from the spinning tub mode to the pulsator mode will be described as follows.

When a voltage is applied to the washing machine, the washing machine is initialized as the spinning tub mode, whereby it is required to switch the spinning tub mode to the pulsator mode so as to perform the washing or rinsing cycle.

Figure 8:
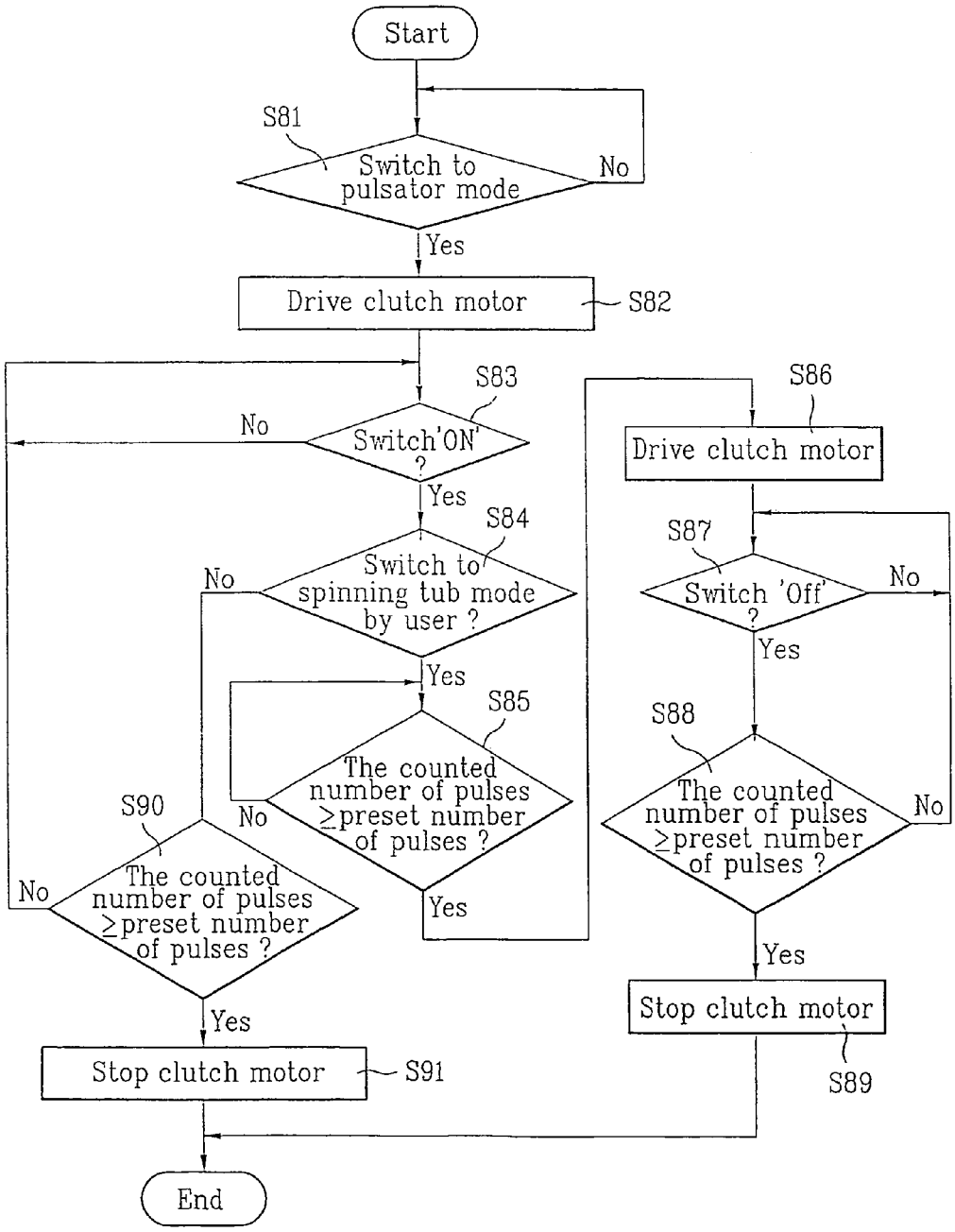
FIG. 8 is a flow chart illustrating a method for switching a power transmission mode according to the first embodiment of the present invention.

As shown in FIG. 8, the micom 100 determined whether it requires the switching to the pulsator mode for the washing or rinsing cycle (S81). In case of that the washing machine is initialized, if the user requires to perform the washing or rinsing cycle after performing or completing the spinning cycle, the micom 100 determines that it requires the switching to the pulsator mode.

If it is required to perform the switching to the pulsator mode, under control of the micom 100, the BLDC motor 7 is alternately rotated in left and right directions momentarily for N times (for example, four times) or a preset time period (one to three seconds) at a rotation angle smaller than a rotation angle in the washing cycle.

The BLDC motor 7 is alternately rotated in left and right directions for eliminating a cause that impedes moving up of the coupling 15. The moving up of the coupling 15 is impeded by surface pressures of the serrations 150*a* and 150*b* exerted to the serration on the lower part of the spinning shaft 5 and the serration 161*b* on the upper part of the inner connector 16*b* in opposite directions caused by opposite direction forces of the spinning shaft 5 and the inner connector 16*b* engaged with the coupling 15 at stopping of the washing machine. Therefore, before proceeding, to the step for moving up the coupling 15 to a position of the washing mode, the BLDC motor 7 is alternately rotated in left and right directions for eliminating the cause that impedes moving up of the coupling 15.

After that, the micom 100 puts the clutch motor 60 into operation for rotating the cam 600 (S82). Then, the micom 100 determines whether the switch 650 is turned on by the rotation of the cam 600 (S83). The turning-on state of the switch 650 means that the gear teeth 151 of the coupling 15 are engaged with the gear teeth 221 of the coupling stopper 22. Therefore, by determining the turning-on state of the switch 650, it is possible to determine whether the engagement of the gear teeth 151 of the coupling 15 with the gear teeth 221 of the coupling stopper 22 is done or not.

As a result of the determination in the step S83, if it is determined that the switch 650 is turned on, the pulse counting part 72 counts the number of pulses of the AC voltage supplied to the clutch motor 60 while the switch 650 is in the turning-on state. Then, the micom 100 determines whether the counted number of pulses is greater than a preset number of pulses, for example, '66' (S90).

As a result of the determination in the step S90, if the counted number of pulses is smaller than the preset number of pulses, the steps S83 and S90 are repeated until the counted number of pulses is equal to, or greater than the preset number of pulses. While the steps S83 and S90 are repeated, the clutch motor 60 is driven continuously. Therefore, the engagement of the gear teeth 151 of the coupling 15 with the gear teeth 221 of the coupling stopper 22 becomes more positive.

As a result of the determination in the step S90, if the counted number of pulses of the AC voltage is equal to or greater than the preset number of pulses, the clutch motor 60 is stopped (S91), and the BLDC motor 7 is alternately rotated in left and right directions momentarily under control of the micom 100. In this instance, the BLDC motor 7 is alternately rotated in left and right directions at an angle smaller than an angle in washing for N times (for example, four times) or a preset time period (one to three seconds). The left and right direction alternate rotation is made for preventing the BLDC motor 7 from putting into operation in state of that the engagement of the gear teeth 151 of the coupling 15 with the gear teeth 221 of the coupling stopper 22 is not perfectly caused by mechanical or motor malfunction, in advance.

On completing the switching to the pulsator mode, the micom 100 performs the washing or rinsing cycle. After completing the washing or rinsing cycle, the washing machine is switched from the pulsator mode to the spinning tub mode so as to perform the spinning cycle. Usually, the switching to the spinning tub mode is progressed after completing the switching to the pulsator mode. However, it is possible to perform the switching to the spinning tub mode during switching to the pulsator mode by the user's command.

Next, a process of switching from the pulsator mode to the spinning tub mode will be described as follows.

The micom 100 checks whether the user's command requiring the switching to the spinning tub mode is inputted during switching to the pulsator mode (S84). As mentioned above, if the user's command is not inputted, the micom 100 progresses the steps S90 and S91 sequentially, so as to complete the switching, to the pulsator mode, and then the switching to the spinning tub mode is progressed.

However, if the user's command for switching to the spinning tub mode is inputted during switching to the pulsator mode, the micom 100 checks whether the counted number of pulses is equal to or greater than the preset number of pulses, for example '66' (S85).

As a result of the determination in the step S85, if the counted number of pulses is smaller than the preset number of pulses, the step S85 is repeated until the counted number of pulses is equal to, or greater than the preset number of pulses. Therefore, the engagement of the gear teeth 151 of the coupling 15 with the gear teeth 221 of the coupling stopper 22 becomes more positive. Simultaneously, it is possible to obtain the time for correctly positioning the cam 600 at the initial point.

As a result of the determination in the step S85, if the number of pulses of AC voltage is equal to or greater than the preset number of pulses, the micom 100 considers that the cam 600 is positioned at the initial point. After that, under control of the micom 100, the clutch motor 60 is stopped, and the BLDC motor 7 is alternately rotated in left and right directions at an angle smaller than an angle in washing for N times (for example, four times) or a preset time period (one to three seconds).

After that, the micom 100 puts the clutch motor 60 into operation for rotating the cam 600 (S86). Then, the micom 100 determines whether the switch 650 is turned off by the rotation of the cam 600 (S87). Herein, the turning-off state of the switch 650 means that disengagement of the gear teeth 151 of the coupling 15 with the gear teeth 221 of the coupling stopper 22. Therefore, by determining the turning-off state of the switch 650, it is possible to determine whether the disengagement of the gear teeth 151 of the coupling 15 with the gear teeth 221 of the coupling stopper 92 is done or not.

As a result of the determination in the step S87, if it is determined that the switch 650 is turned off, the pulse counting part 72 counts the number of pulses of the AC voltage supplied to the clutch motor 60 while the switch 650 is in the turning-off state. Then, the micom 100 determines whether the counted number of pulses is greater than a preset number of pulses, for example, '66' (S88).

As a result of the determination in the step S88, if the counted number of pulses is smaller than the preset number of pulses, the process proceeds back to the step S87. Then, the steps S87 and S88 are repeated until the counted number of pulses is equal to, or greater than the preset number of pulses. While the steps S87 and S88 are repeated, the clutch motor 60 is driven continuously Accordingly, the disengagement of the gear teeth 151 of the coupling 15 with the gear teeth 221 of the coupling stopper 22 becomes perfect.

In opposite to this, as a result of the determination in the step S88, if the counted number of pulses of the AC voltage is equal to, or greater than the preset number of pulses, the clutch motor 60 is stopped (S89), and the BLDC motor 7 is alternately rotated in left and right directions momentarily under the control of the micom 100. In this instance, the BLDC motor 7 is alternately rotated in left and right directions at an angle smaller than an angle in washing for N times (for example, four times) or a preset time period (one to three seconds). The four times of left and right direction alternate rotation is made for preventing the BLDC motor 7 from putting into operation in state of that the disengagement of the gear teeth 151 of the coupling 15 with the gear teeth 221 of the coupling stopper 22 is not perfect due to mechanical or motor malfunction, in advance. As mentioned above, after completing the switching to the spinning tub mode, the micom 100 performs the spinning cycle.

SECOND EMBODIMENT

Figure 9:
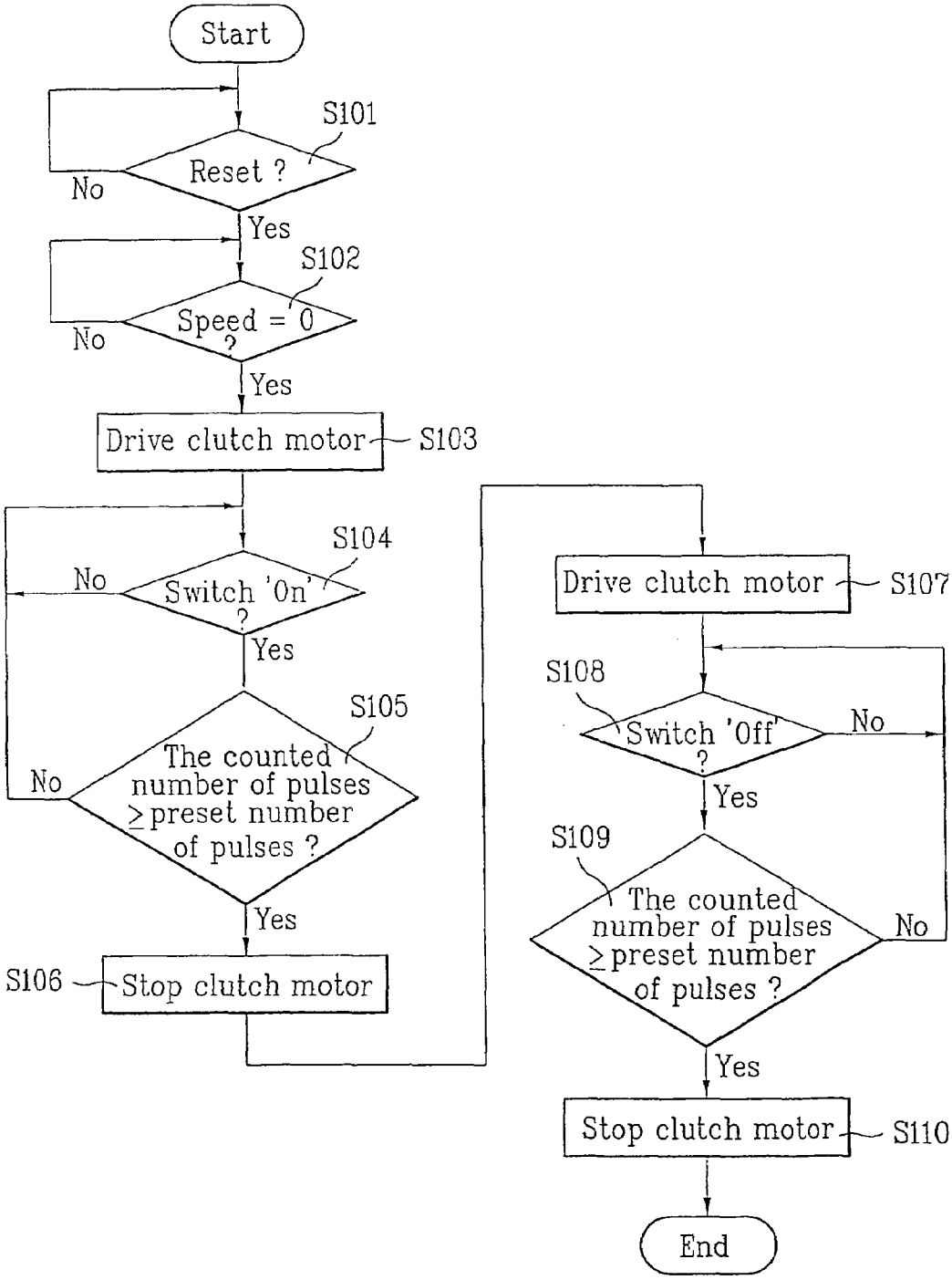
FIG. 9 is a flow chart illustrating a method for switching a power transmission mode according to the second embodiment of the present invention.

FIG. 9 is a flow chart illustrating a method for switching a power transmission mode of a washing machine according to the second embodiment of the present invention. In the method for switching the power transmission mode of the washing machine according to the second embodiment of the present invention, it is possible to stably switch the power transmission mode when a power of the washing machine is reset during driving the washing machine.

While the washing machine performs a washing, rinsing or spinning cycle, if the power is reset according to a user or a malfunction, the micom 100 checks whether the power is reset (S101).

If it is determined that the power is reset, under control of the micom 100, the motor sensint part 73 checks whether the BLDC motor 7 is rotated (S102). The micom 100 receives data regarding the rotation of the BLDC motor 7 from the motor sensing part 73. That is, the micom 100 checks whether a rotation speed of the BLDC motor 7 is '0' from the data.

If it is determined that the BLDC motor 7 is rotated, the micom 100 senses the BLDC motor 7 for a preset time period. For example, if the BLDC motor 7 is not stopped after passage of ten minutes, the micom 100 controls the display part 700 to display an error message, thereby informing the malfunction of the washing machine to the user. Accordingly, the power is turned off.

If it is determined that the BLDC motor 7 is not rotated, the micom 100 starts to switch the power transmission mode. That is, if the rotation of the BLDC motor 7 is stopped in the preset time period, the micom 100 starts to switch the power transmission mode.

For switching to the pulsator mode, the micom 100 puts the clutch motor 60 into operation (S103). At this time, the cam 600 is rotated according to the clutch motor 60. Also, the micom 100 determines whether the switch 650 is turned on by the rotation of the cam 600 (S104). By determining whether the switch 650 is in the turning-on state, it is possible to check whether the gear teeth 151 of the coupling 15 are engaged with the gear teeth 221 of the coupling stopper 22.

As a result of the determination in the step S104, if it is determined that the switch 650 is not in the turning-on state, the micom 100 checks repetitively whether the switch 650 is turned on.

As a result of the determination in the step S104, if it is determined that the switch 650 is in the turning-on state, the pulse counting part 72 counts the number of pulses of AC voltage supplied to the clutch motor 60 while the switch 650 is in the turning-on state. The micom 100 determines whether the counted number of pulses is greater than a preset number of pulses, for example, '66' (S105).

As a result of the determination in the step S105, if the counted number of pulses is smaller than the preset number of pulses, the steps S104 and S105 are repeated until the counted number of pulses is equal to, or greater than the preset number of pulses. At this time, the clutch motor 60 is driven continuously while the steps S104 and S105 are repeated.

As a result of the determination in the step S105, if the number of pulses of AC voltage is equal to, or greater than the preset number of pulses, the clutch motor 60 is stopped under control of the micom 100 (S106).

As mentioned above, after completing the switching to the pulsator mode, the switching to the spinning tub mode is progressed. In case of that the user desires to perform the washing or rinsing cycle after resetting the power, the micom 100 performs the washing or rinsing cycle after switching the pulsator mode to the spinning tub mode.

For switching the pulsator mode to the spinning tub mode, the micom 100 drives the clutch motor 60 (S107). At this time, the cam 600 is rotated according to the clutch motor 60. Also, the micom 100 determines whether the switch 650 is turned off by the rotation of the cam 600 (S108). By determining whether the switch 650 is turned off, it is possible to determine whether the gear teeth 151 of the coupling 15 are disengaged with the gear teeth 221 of the coupling stopper 22.

As a result of the determination in the step S 108, if it is determined that the switch 650 is turned off, the pulse counting part 72 counts the number of pulses of AC voltage supplied to the clutch motor 60 while the switch 650 is turned off. Then, the micom 100 determines whether the counted number of pulses is greater than a preset number of pulses, for example, '66' (S109).

As a result of the determination in the step S109, if the counted number of pulses is smaller than the preset number of pulses, the process proceeds back to the step S108. Then, the steps S 108 and S109 are repeated until the counted number of pulses is equal to, or greater than the preset number of pulses. At this time, the clutch motor 60 is driven continuously while the steps S108 and S109 are repeated.

As a result of the determination in the step S109, if the number of pulses of AC voltage is equal to, or greater than the preset number of pulses, the clutch motor 60 is stopped under control of the micom 100 (S110). Herein, the clutch motor 60 is stopped at a point of completing the switching to the spinning tub mode and starting the switching to the pulsator mode, simultaneously.

As mentioned above, after completing the pulsator mode to the spinning tub mode, if the user's command requiring the washing or rinsing cycle is inputted to the micom 100, the micom 10 switches the spinning tub mode to the pulsator mode, thereby performing the washing or rinsing cycle.

THIRD EMBODIMENT

Figure 10:
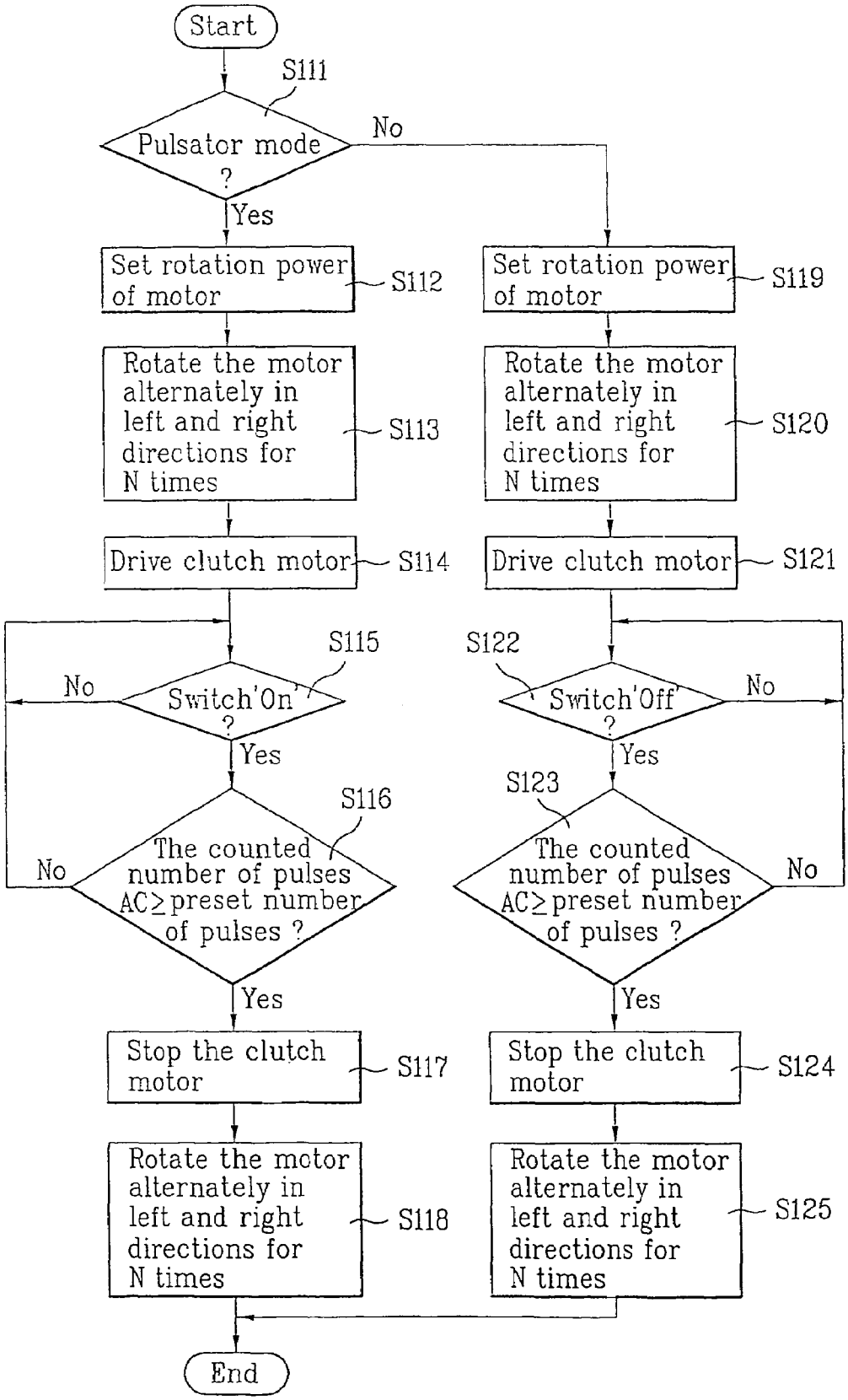
FIG. 10 is a flow chart illustrating a method for switching a power transmission mode according to the third embodiment of the present invention.

FIG. 10 is a flow chart illustrating a method for switching a power transmission mode according to the third embodiment of the present invention. For performing the washing or rinsing cycle, it is required to operate the washing machine in the pulsator mod. Meanwhile, in order to perform the spinning cycle, it is required to operate the washing machine in the spinning tub mode. Accordingly, the micom 100 switches the mode of the washing machine according to the respective washing, rinsing and spinning cycles.

As shown in FIG. 10, the micom 100 determines that the washing machine is operated in the pulsator mode or the spinning tub mode (S111). In case of that the washing machine is initialized, and the user desires to perform the washing or rinsing cycle after progressing or completing the spinning cycle, the micom 100 determines that it requires the switching to the pulsator mode. After completing the washing and rinsing cycles, the micom 100 determines that it requires the switching to the spinning tub mode.

As a result of the determination in the step S111, if it is determined that it requires the switching to the pulsator mode, the micom 100 sets the alternate rotation power of the BLDC motor 7 (S112). The alternate rotation power means the power of the BLDC motor 7 for being alternately rotated in left and right directions. That is, the alternate rotation power of the BLDC motor 7 is classified into various levels according to the amount of laundry and water level in the inner tub of the washing machine, or according to the voltage inputted to the BLCD motor 7. Accordingly, the micom 100 sets the alternate rotation power of the BLCD motor 7 according to the water level in the inner tub and the amount of laundry, or the input voltage.

In case of that the alternate rotation power is set on the basis of the water level and the amount of laundry, if the water level is high or the amount of laundry is large, the alternate rotation power increases. Meanwhile, if the water level is low or the amount of laundry is small, the alternate rotation power decreases. For example, if the amount of laundry is 'large', it is required to set the alternate rotation power of the BLDC motor 7 as maximum. If the amount of laundry is 'middle', it is required to set the alternate rotation power of the BLDC motor 7 as middle, and if the amount of laundry is 'low', it is required to set the alternate rotation power of the BLDC motor 7 as minimum.

In case of that the alternate rotation power is set on the basis of the voltage inputted to the BLDC motor 7, if the input voltage is high, the alternate rotation power decreases, and, if the input voltage is low, the alternate rotation power increases, thereby alternately rotating the BLDC motor 7 without regard to variety of input voltage. For example, if the input voltage is at 310V, the alternate rotation power of the BLDC motor 7 is set as minimum. Meanwhile, if the input voltage is at 300V, the alternate rotation power of the BLDC motor 7 is set as middle. Also, if the input voltage is at 250V, the alternate rotation power of the BLDC motor 7 is set as minimum.

After setting the alternate rotation power of the BLDC motor 7, under control of the micom 100, the BLDC motor 7 is alternately rotated in left and right directions momentarily for N times (for example, four times) or a preset time period (one to three seconds) at a rotation angle smaller than a rotation angle in the washing cycle.

Then, the micom 100 puts the clutch motor 60 into operation so as to rotate the cam 600 after alternately rotating the BLDC motor 7 (S114). Also, the micom 100 determines whether the switch 650 is turned on by the rotation of the cam 600 (S115). By determining whether the switch 650 is turned on, it is possible to check whether the gear teeth 151 of the coupling 15 are engaged with the gear teeth 221 of the coupling stopper 22.

As a result of the determination in the step S115, if it is determined that the switch 650 is not in the turning-on state, the micom 100 repetitively checks whether the switch 650 is turned on.

As a result of the determination in the step S115, if it is determined that the switch 650 is in the turning-on state, the pulse counting part 72 counts the number of pulses of AC voltage supplied to the clutch motor 60 while the switch 650 is turned on. Then, the micom 100 determines whether the counted number of pulses is greater than a preset number of pulses, for example, '66' (S116).

As a result of the determination in the step S116, if the counted number of pulses is smaller than the preset number of pulses, the steps S115 and S116 are repeated until the counted number of pulses is equal to, or greater than the preset number of pulses. Herein, the clutch motor 60 is continuously driven while the steps S115 and S116 are repeated. Accordingly, the engagement of the gear teeth 151 of the coupling 15 with the gear teeth 221 of the coupling stopper 22 becomes more positive.

As a result of the determination in the step S116, if the number of pulses of AC voltage is equal to, or greater than the preset number of pulses, the clutch motor 60 is stopped (S117) under control of the micom 100. After that, the BLDC motor 7 is alternately rotated in left and right directions according to the preset rotation power (S118). In this case, the BLDC motor 7 is alternately rotated in left and right directions momentarily for N times (for example, four times) or a preset time period (one to three seconds) at a rotation angle smaller than a rotation angle in the washing cycle.

As mentioned above, after completing the switching to the pulsator mode, the micom 100 performs the washing or rinsing cycle. After completing the washing or rinsing cycle, the washing machine switches the pulsator mode to the spinning tub mode so as to perform the spinning cycle. Usually, the switching to the spinning tub mode is progressed after completing the switching to the pulsator mode. However, it is possible to progress the switching to the spiraling tub mode during switching to the pulsator mode by the user's command.

As a result of the determination in the step S111, if it is determined that it requires the switching to the spinning tub mode, the micom 100 sets the alternate rotation power of the BLDC motor 7 (S119). After discharging the washing water used in the washing or rinsing cycle, the spinning cycle is progressed. In this respect, the alternate rotation power of the BLDC motor 7 for the spinning cycle is classified into various levels according to the amount of laundry absorbing the washing water therein, or according to the voltage inputted to the BLDC motor 7. That is, the micom 100 sets the alternate rotation power according to the amount of laundry or the input voltage.

In case of that the alternate rotation power is set according to the amount of laundry, if the amount of laundry is large, it is required to increase the alternate rotation power. Meanwhile, the amount of laundry is small, it is required to decrease the alternate rotation power. Thus, the BLDC motor 7 is alternately rotated in left and right directions at a uniform speed without regard to a weight of laundry.

The case of setting the alternate rotation power of the BLDC motor 7 according to the voltage inputted to the BLDC motor 7 will be described with reference to the step S112.

If the alternate rotation power of the BLDC motor 7 is set, the BLDC motor 7 is alternately rotated in left and right directions momentarily for N times (for example, four times) or a preset time period (one to three seconds) according to the preset alternate rotation power. Herein, the BLDC motor 7 is rotated at a rotation angle smaller than a rotation angle in the washing cycle.

After rotating the BLDC motor 7 alternately in left and right directions, the micom 100 puts the clutch motor 60 into operation so as to rotate the cam 600 (S121). Then, the micom 100 determines whether the switch 650 is turned off by the rotation of the cam 600 (S122). By determining whether the switch 650 is turned off, it is possible to determine whether the engagement of the gear teeth 151 of the coupling 15 with the gear teeth 221 of the coupling stopper 22 is done or not.

As a result of the determination in the step S122, if it is determined that the switch 650 is turned off, the pulse counting part 72 counts the number of pulses of AC voltage supplied to the clutch motor 60 while the switch 650 is in the turning-off state. Then, the micom 100 determines whether the counted number of pulses is greater than a preset number of pulses, for example, '66' (S123).

As a result of the determination in the step S123, if the counted number of pulses is smaller than the preset number of pulses, the process progresses back to the step S122. Then, the steps S122 and S123 are repeated until the counted number of pulses is equal to, or greater than the preset number of pulses. La this state, the cultch motor 60 is driven continuously while the steps S122 and S123 are repeated. Accordingly, the gear teeth 151 of the coupling 15 are disengaged with the gear teeth 221 of the coupling stopper perfectly.

As a result of the determination in the step S123, if the number of pulses of AC voltage is greater than the preset number of pulses, the clutch motor 60 is stopped under control of the micom 100. After that, the BLDC motor 7 is alternately rotated in left and right direction according to the alternate rotation power set in the step S119. Herein, the BLDC motor 7 is alternately rotated in left and right directions momentarily for N times (for example, four times) or a preset time period (one to three seconds) at a rotation angle smaller than a rotation angle in the washing cycle. As mentioned above, after completing the switching to the spinning tub mode, the micom 100 performs the spinning cycle.

FOURTH EMBODIMENT

Figure 11:
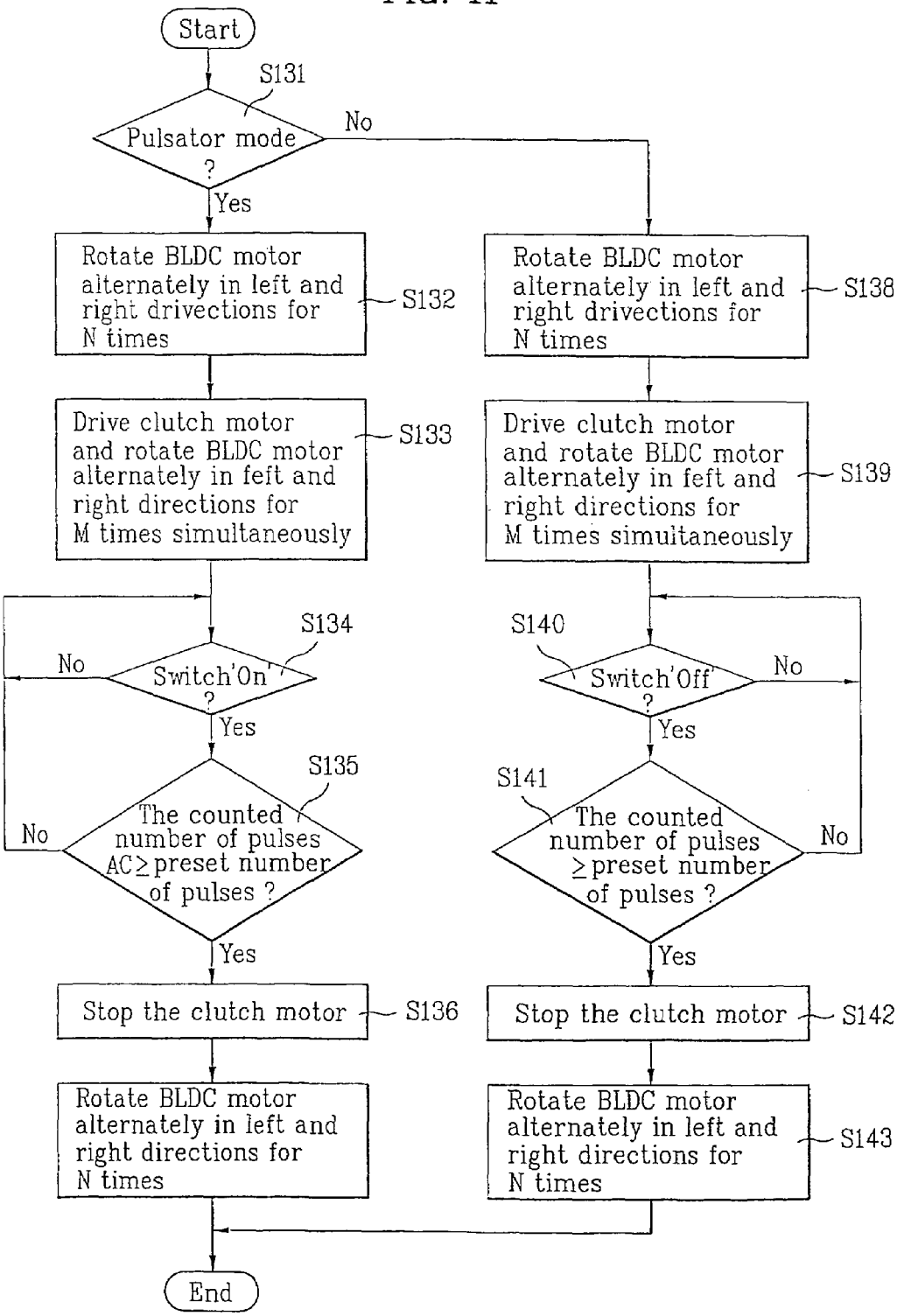
FIG. 11 is a flow chart illustrating a method for switching a power transmission mode according to the fourth embodiment of the present invention.

FIG. 11 is a flow chart illustrating a method for switching a power transmission mode of a washing machine according to the fourth embodiment of the present invention.

As shown in FIG. 11, the micom 100 determines that the washing machine is operated in the pulsator mode or the spinning tub mode (S131). In case of that the washing machine is initialized, and the user desires to perform the washing or rinsing cycle after progressing or completing the spinning cycle, the micom 100 determines that it requires the switching to the pulsator mode. After completing the washing and rinsing cycles, the micom 100 determines that it requires the switching to the spinning tub mode.

As a result of the determination in the step S131, if it is determined that it requires the switching to the pulsator mode, under control of the micom 100, the BLDC motor 7 is alternately rotated in left and right directions momentarily for N times (for example, four times) or a preset time period (one to three seconds) at a rotation angle smaller than a rotation angle in the washing cycle.

After alternately rotating the BLDC motor 7, the micom 100 puts the clutch motor 60 into operation so as to rotate the cam 600, and rotates the BLDC motor 7 alternately in left and right directions for M times, simultaneously (S133). Then, the micom 100 determines whether the switch 650 is turned on by the rotation of the cam 600 (S134). By determining whether the switch 650 is turned off, it is possible to determine whether the gear teeth 151 of the coupling are engaged with the gear teeth 221 of the coupling stopper 22.

As a result of the determination in the step S134, if it is determined that the switch 650 is not in the turning-on state, the micom 100 repetitively determines whether the switch 650 is turned on. As a result of the determination in the step S134, if it is determined that the switch 650 is in the turning-on state, the pulse counting part 72 counts the number of pulses of AC voltage supplied to the clutch motor 60 while the switching 650 is in the turning-on state. Then, the micom 100 determines whether the counted number of pulses is greater than a preset number of pulses, for example, '66' (S135).

As a result of the determination in the step S135, if the counted number of pulses is smaller than the preset number of pulses, the steps S134 and S135 are repeated until the counted number of pulses is equal to, or greater than the preset number of pulses. In this case, the clutch motor 60 is continuously driven while the steps S134 and S135 are repeated. Accordingly, the engagement of gear teeth 151 of the coupling 15 with the gear teeth 221 of the coupling stopper 22 becomes more positive.

As a result of the determination in the step S135, if the number of pulses of AC voltage is equal to, or greater than the preset number of pulses, the clutch motor 60 is stopped under control of the micom 100. After that, the BLDC motor 7 is rotated alternately in left and right directions according to the preset alternate rotation power (S137). At this time, the BLDC motor 7 is alternately rotated in left and right directions momentarily for N times (for example, four times) or a preset time period (one to three seconds) at a rotation angle smaller than a rotation angle in the washing cycle.

The BLDC motor 7 is rotated alternately in left and right direction in the step S132, S133 and S137. In the respective steps S132, S133 and S137, it is possible to differently set the alternate rotation power of the BLDC motor 7.

As a result of the determination in the step S131, if it is determined that it requires the switching to the spinning tub mode, under control of the micom 100, the BLDC motor 7 is alternately rotated in left and right directions momentarily for N times (for example, four times) or a preset time period (one to three seconds) at a rotation angle smaller than a rotation angle in the washing cycle.

After rotating the BLDC motor 7 alternately in left and right directions, the micom 100 puts the clutch motor 60 into operation so as to rotate the cam 600, and rotates the BLDC motor 7 alternately in left and right direction for M times, simultaneously (S139). Then, the micom 100 determines whether the switch 650 is turned off by the rotation of the cam 600 (S140). By determining whether the switch 650 is turned off, it is possible to determine whether the gear teeth 151 of the coupling 15 are disengaged with the gear teeth 221 of the coupling stopper 22.

As a result of the determination in the step S140, if it is determined that the switch 650 is turned off, the pulse counting part 72 counts the number of pulses of AC voltage supplied to the clutch motor 60 while the switch 650 is turned off.

Then, the micom 100 determines whether the counted number of pulses is greater than a preset number of pulses, for example, '66' (S141).

As a result of the determination in the step S141, if the counted number of pulses is smaller than the preset number of pulses, the process progresses back to the step S140. Then, the steps S140 and S141 are repeated until the counted number of pulses is equal to, or greater than the preset number of pulses. In this case, the clutch motor 60 is continuously driven while the steps S140 and S141 are repeated. Accordingly, the gear teeth 151 of the coupling 15 are disengaged with the gear teeth 221 of the coupling stopper 22 perfectly.

As a result of the determination in the step S141, if the number of pulses of AC voltage is equal to, or greater than the preset number of pulses, the clutch motor 60 is stopped under control of the micom 100 (S142). After that, the BLDC motor 7 is rotated alternately in left and right directions (S143). Herein, the BLDC motor 7 is alternately rotated in left and right directions momentarily for N times (for example, four times) or a preset time period (one to three seconds) at a rotation angle smaller than a rotation angle in the washing cycle.

As mentioned above, after completing the switching to the spinning tub mode, the micom 100 progresses the spinning cycle.

The BLDC motor 7 is rotated alternately in left and right directions in the respective steps S138, S139 and S143. In the respective steps S13S, S139 and S143, it is possible to differently set the alternate rotation power of the BLDC motor 7.

INDUSTRIAL APPLICABILITY

As mentioned above, the apparatus and method for switching the power transmission mode of the washing machine according to the present invention has the following advantages.

In the apparatus and method for switching the power transmission mode of the washing machine according to the present invention, it is possible to check the position of the cam according to the state of the switch, whereby it is possible to position the cam at the correct initial point when switching the power transmission mode.

Also, the BLDC motor is rotated alternately in left and right directions momentarily, whereby it is possible to engage or disengage the gear teeth of the coupling with the gear teeth of the coupling stopper perfectly. Accordingly, when switching the power transmission mode, it is possible to prevent components of the washing machine from being damaged, and to stably switch the power transmission mode.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An apparatus for switching a power transmission mode of a washing machine comprising:

a coupling for selectively transmitting a power of a BLDC motor to a washing shaft and a spinning shaft via a coupling stopper;

a clutch including a clutch motor for moving up/down the coupling by driving a cam, the cam fitted to be rotatable with the clutch motor and having a cam recess surface, and a switch contacting the cam recess surface for providing a switching signal in response to the rotation of the clutch motor;

a motor sensing part for sensing the rotation of the BLDC motor;

a power supplying part for supplying a voltage to the clutch motor;

a pulse counting part for counting the number of pulses of power supplied to the clutch motor from the power supplying part when the switching signal of the switch is provided; and a micom for repeating rotation of the cam until the counted number of pulses is equal to, or greater than a preset number of pulses on driving the clutch motor and for checking whether the power of the BLDC motor is reset by data provided from the motor sensing part.

2. The apparatus as claimed in claim 1, wherein the micom rotates the motor alternately in left and right directions according to a preset alternate rotation power before driving the clutch motor and after stopping the clutch motor.

3. The apparatus as claimed in claim 2, wherein the micom sets the alternate rotation power of the motor according to the amount of laundry and water level.

4. The apparatus as claimed in claim 3, wherein the micom sets the alternate rotation power of the motor to be higher as the amount of laundry is large and the water level is high, and the micom sets the alternate rotation power of the motor to be lower as the amount of laundry is small and the water level is low.

5. The apparatus as claimed in claim 2, wherein the micom sets the alternate rotation power according to a voltage inputted to the motor.

6. The apparatus as claimed in claim 5, wherein the micom sets the alternate rotation power of the motor to be lower as the voltage inputted to the motor is high, and the micom sets the alternate rotation power of the motor to be higher as the voltage inputted to the motor is low.

7. The apparatus as claimed in claim 1, wherein the micom determines whether the motor is rotated when a power is reset.

8. The apparatus as claimed in claim 7, wherein the micom turns off the power in case of that the motor is rotated after a lapse of a preset time period.

9. The apparatus as claimed in claim 7, wherein the micom drives the clutch motor after rotation of the motor is stopped.

10. The apparatus as claimed in claim 1, wherein the micom drives the clutch motor, and simultaneously rotates the motor alternately in left and right directions.

11. The apparatus as claimed in claim 1, wherein the switch outputs a switching signal for a turning-on state so as to perform a switch to a power transmission mode for washing and rinsing cycles.

12. The apparatus as claimed in claim 1, wherein the switch outputs a switching signal for a turning-off state so as to perform a switch to a power transmission mode for a spinning cycle.

* * * * *